US005172542A

United States Patent [19]

Stahlecker et al.

[11] Patent Number: 5,172,542

[45] Date of Patent: Dec. 22, 1992

[54] SPINNING MACHINE FOR PNEUMATIC FALSE-TWIST SPINNING

[75] Inventors: Fritz Stahlecker, Josef-Neidhart-Strasse 18, 7347 Bad Überkingen; Josef Scholz, Bad Ditzenbach, both of Fed. Rep. of Germany

[73] Assignees: Fritz Stahlecker; Hans Stahlecker, Fed. Rep. of Germany

[21] Appl. No.: 768,109

[22] Filed: Sep. 30, 1991

Related U.S. Application Data

[63] Continuation of Ser. No. 544,955, Jun. 28, 1990, abandoned.

[30] Foreign Application Priority Data

Jul. 11, 1989 [DE] Fed. Rep. of Germany ..... 3922769

[51] Int. Cl.[5] ..... D01H 5/28; D01H 11/00

[52] U.S. Cl. ..... 57/328; 57/300; 57/304; 57/315; 57/333; 57/350; 74/98

[58] Field of Search ..... 57/300-301, 57/304, 315, 328, 333, 350; 74/98

[56] References Cited

U.S. PATENT DOCUMENTS

| | | | |
|---|---|---|---|
| 4,114,358 | 9/1978 | Tsuchida et al. | 57/328 |
| 4,545,193 | 10/1985 | Tanaka et al. | 57/328 X |
| 4,550,560 | 11/1985 | Tanaka et al. | 57/279 X |
| 4,619,109 | 10/1986 | Suzuki et al. | 57/328 X |
| 4,732,048 | 3/1988 | Sakakibara et al. | 74/98 |
| 4,819,419 | 4/1989 | Stahlecker et al. | 57/261 |
| 4,858,421 | 8/1989 | Stahlecker et al. | 57/328 |
| 4,991,263 | 2/1991 | Stahlecker | 19/236 X |

FOREIGN PATENT DOCUMENTS 3411577 10/1984 Fed. Rep. of Germany .

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

In a spinning machine for pneumatic false-twist spinning, a plurality of spinning points are provided which are each equipped with one drafting unit. Two air nozzles are connected behind a pair of delivery rollers of the drafting unit and are pivotable around a separate swivel shaft and are connected by a restricted guidance in such a manner that, by an actuating movement, they can be moved into servicing positions which deviate from one another.

20 Claims, 3 Drawing Sheets

X,Y 1, 2
A,B
7
5
8
11
58
35
44
16
46
45
4
26
41
17
47
II
27
18
48
31
28
19
33
49
29
59
20
30
64
66
40
39
67
38
9
63
68
65

X
Y
1
2
31
8
10
11
52
54
56
58
34
12
16
46
21
26
3
4
43
5
6
13
17
42
7
47
22
44
41
I
14
18
48
23
32
33
15
19
49
24
29
53
55
57
50
51
59
25
20
30
C
D
E
F
40
61
64
65
39
62
9
10
60
38
36
37
63
11
A
B

SPINNING MACHINE FOR PNEUMATIC FALSE-TWIST SPINNING

This is a continuation of now abandoned application Ser. No. 07/544,955 filed Jun. 28, 1990.

BACKGROUND AND SUMMARY OF THE INVENTION

The invention relates to a spinning machine for pneumatic false-twist spinning having a plurality of spinning points with one drafting unit respectively, at least two air nozzles being connected behind a pair of delivery rollers of a drafting unit and being pivotable around a swivel shaft from an operating position into a servicing position.

In a spinning machine of the initially mentioned type described in German Patent Document DE-A 36 38 110, two air nozzles respectively are connected behind the drafting units and can each be swung about separate swivelling shafts from the operating position into a servicing position. So that the respective successive air nozzles arrive in different servicing positions in which they are accessible, for example, to a cleaning operation, two movements respectively are required.

It is also known in a spinning machine described in German Patent Document DE-A 34 11 577 to arrange the air nozzles of the individual spinning points so that they can be slid on slide rods transversely with respect to the drafting units from the operating position into a servicing position. However, a shifting movement of this type is not sufficient if one or several air nozzles are provided that are arranged behind one another because then the individual air nozzles are not easily accessible at their inlet openings and/or outlet openings in the servicing position.

It is an object of the invention to develop a spinning machine of the initially mentioned type such that, also in the case of spinning points with several air nozzles arranged behind one another, a servicing position can be reached in a simple manner in which the air nozzles are easily accessible for servicing work.

This object is achieved in that the air nozzles of each spinning point can be brought into servicing positions that deviate from one another by means of an actuating movement.

The construction according to preferred embodiments of the invention is particularly suitable for fully automated spinning machines which are equipped with a movable servicing carriage. The servicing carriage requires only one actuating element in order to expose both air nozzles in a generous manner for a servicing operation, particularly for a cleaning.

In an advantageous development of the invention, it is provided that the air nozzles are held in a common holding device which can be swivelled around a first swivel shaft and at which one of the air nozzles is held so that it can be swivelled around a second swivel shaft, in which case the air nozzle which can be swivelled around the second swivel shaft is connected by means of a transmission mechanism with the first swivel shaft which transmits the swivel motion of the holder around the first swivel shaft into an additional swivelling motion of the air nozzle around a second swivel shaft.

This transmission mechanism therefore provides that both air nozzles move apart so that they depart from the relative position which they take up in the operating position. In an advantageous implementation of this development, it is provided that a toothed wheel segment is mounted at the first swivel shaft which mates with a toothed wheel segment connected with the air nozzle which can be swivelled around the second swivel shaft which is in parallel with the first swivel shaft. The two toothed wheel segments provide that, when the holder is swivelled away, at the same time a superimposed movement of the second air nozzle takes place around its swivel shaft.

In a further development of the invention, it is provided that the holder is loaded by means of a spring element in the direction of the operating position in which it rests against a stop. The preferably adjustable stop therefore secures the exact operating position, in which case the forced guiding between the two air nozzle provides that both air nozzles take up the correct operating position.

In a development of the invention, it is provided that two adjacent drafting units respectively are combined to one structural component which has a supporting element for mounting the structural component on a machine frame, in which case the supporting element comprises the first swivel shaft for the holders of the air nozzles of the two drafting units. This development results in the advantage that the drafting unit and the air nozzles are always arranged at correct distances from one another which are free of mounting tolerances. This results in the special advantage that the structural component can be mounted in the manufacturing plant and correspondingly can also be adjusted by means of special tools.

In a further development of the invention, it is provided that the supporting element is constructed as a frame which has two supports extending in the passage direction of a fiber material to be drafted and accommodating bottom rollers constructed as roller sections, and which has two transverse supports of which one is used as the swivel shaft for the holders of the air nozzles and the other one is used as a holding rod for a loading arm accommodating top rollers. This development is also advantageous when the air nozzles are not connected with one another by means of a forced guide.

Other objects, advantages and novel features of the present invention will become apparent from the following detailed description of the invention when considered in conjunction with the accompanying drawings.

DETAILED DESCRIPTION OF THE DRAWINGS

Figure 1:
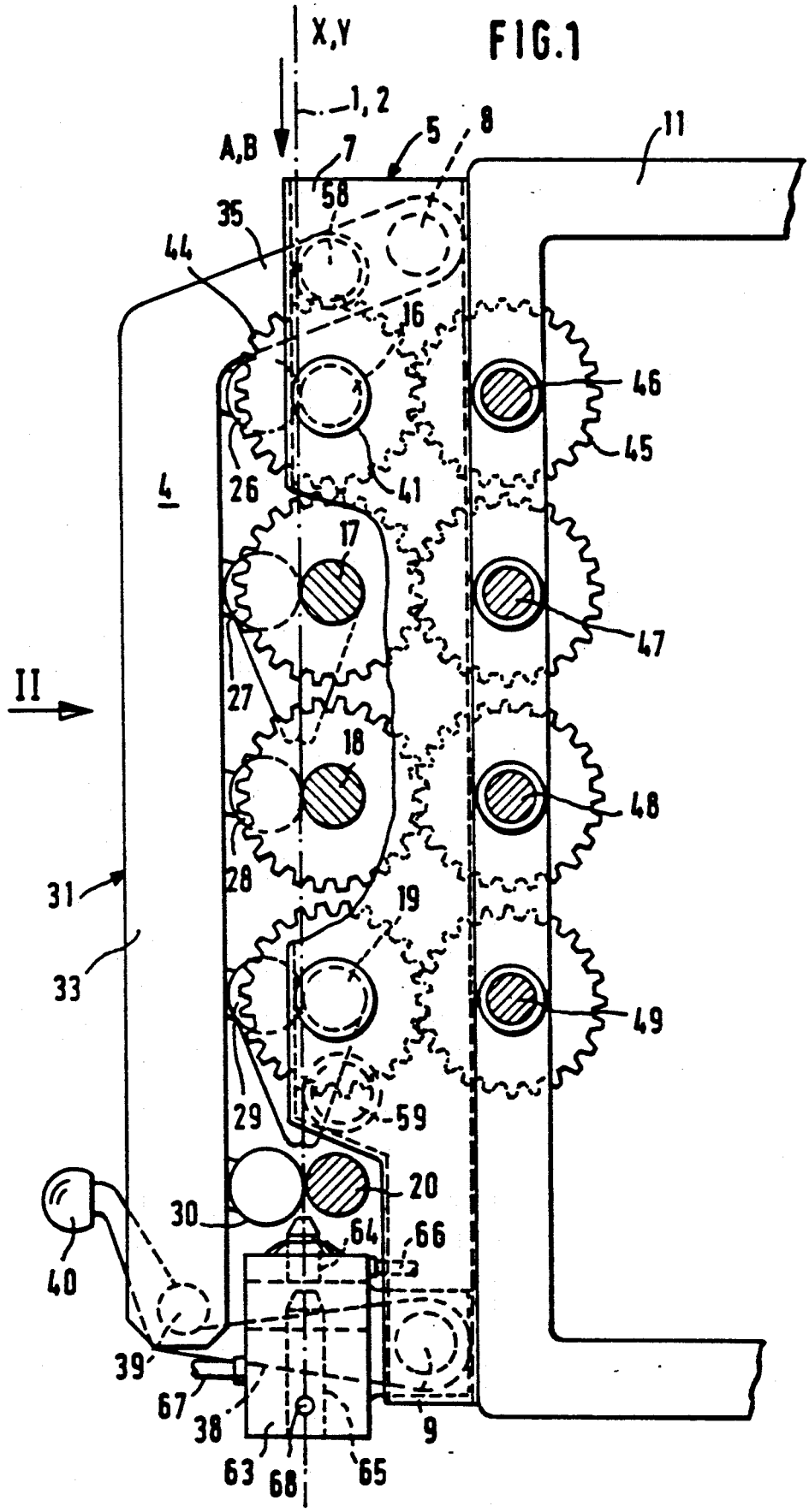
FIG. 1 is a partially sectional lateral view of a segment of a spinning point of a spinning machine, constructed according to a preferred embodiment of the invention, viewed in the direction of arrow I of FIG. 2.
Figure 2:
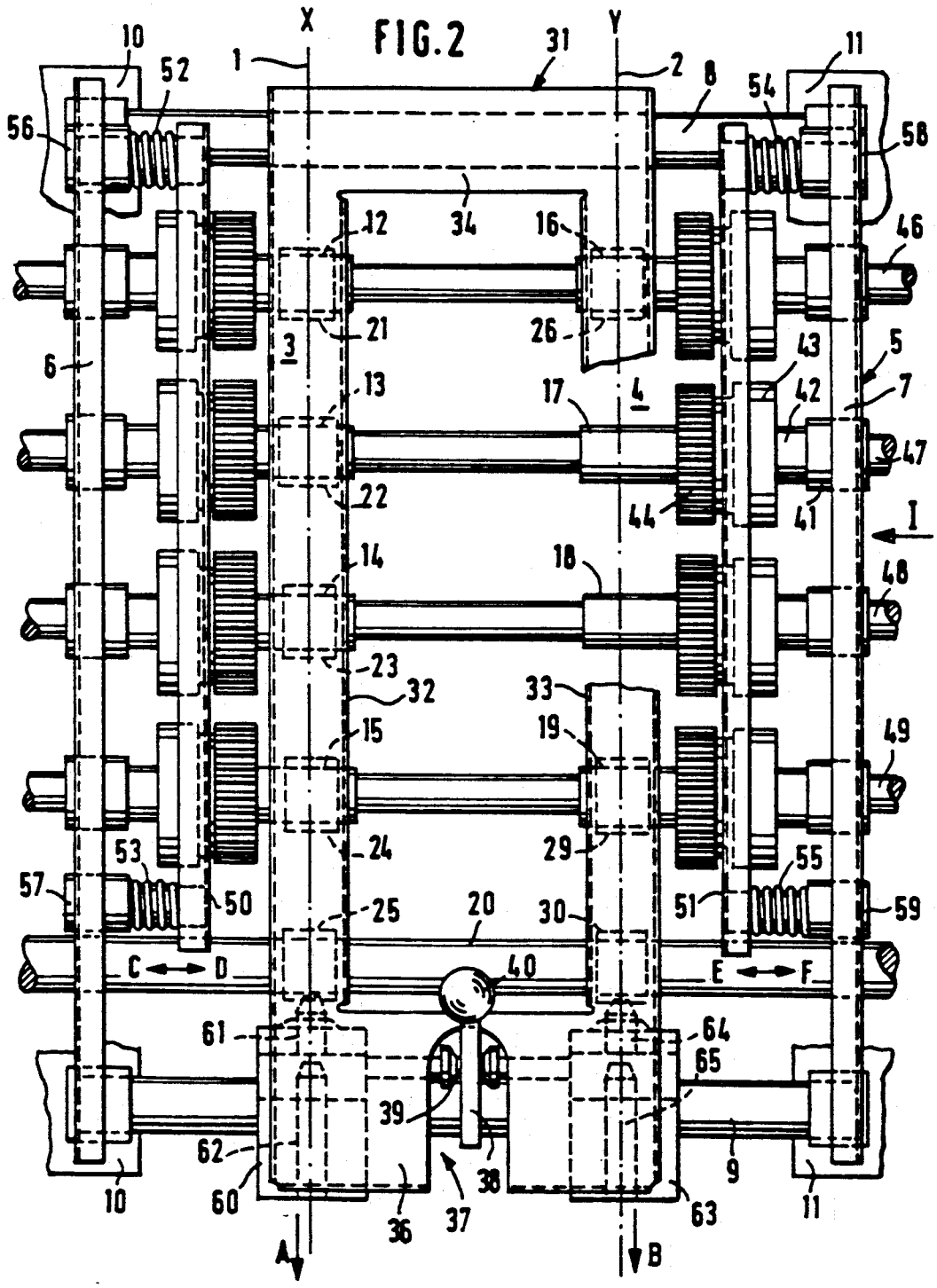
FIG. 2 is a schematic view of two spinning points viewed in the direction of the arrow II of FIG. 1.

FIGS. 1 and 2 show two spinning points or units (X, Y) of a spinning machine for pneumatic false-twist spinning. However, the spinning points (X, Y) are shown only in part. In practice, they are supplemented by withdrawal devices and wind-up devices which are not shown and by means of which the spun yarns 1, 2 indicated by the dash-dotted line are withdrawn in the direction of the arrows (A and B) and are later wound onto spools. While the elements shown in FIGS. 1 and 2, which will be explained later in detail, of the two spinning points (X, Y) have a considerable influence on the quality of the spun yarns (1, 2), the devices which follow do not influence this quality or influence it only relatively little.

Each of the spinning points (X, Y) is provided with a drafting unit 3, 4 , behind which respective air nozzles 61, 62; 64, 65 are connected. The two drafting units 3, 4 and the pertaining air nozzles 61, 62; 64, 65 form a structural unit which, as such, can be mounted on roller stands 10, 11 of a machine frame. A spinning machine has a plurality of structural components of this type with drafting units 3, 4 and air nozzles 61, 62; 64, 65 arranged in pairs.

The basic part of these structural components is a supporting element 5 which is constructed as a frame. This supporting element 5 has two supports 6, 7 which are each constructed as a U-profile from bent sheet metal and which extend in parallel to the travelling direction (A, B) of the yarns 1, 2. At their ends, these supports 6, 7 are connected by way of cross-pieces 8, 9 which are constructed as rods which are round in their cross-section. Bottom rollers 12, 13, 14, 15 of the drafting unit 3 which are constructed as rollers sections are held at the support 6. In a corresponding manner, bottom rollers 16, 17, 18, 19 are held at the support 7. The bottom rollers 12 to 15; 16 to 19 are constructed as sleeve-shaped parts which are disposed on shafts mounted in the supports 6, 7. Toothed wheels 44, by way of respective clutches 43 respectively, are connected with the sleeve-shaped parts. The toothed wheels 44 mate with toothed wheels 45 which are non-rotatably connected with drivable shafts 46, 47, 48, 49 extending through in the longitudinal direction of the machine. Actuating rails 50, 51 are assigned to the clutches 43 of the bottom rollers 12 to 15 and 16 to 19, these actuating rails 50, 51 being arranged on pins 56, 57, 58, 59 which, by means of pressure springs 52, 53, 54, 55 are held in the engaged position. The coupling rails 50, 51 can be moved for the engaging and the disengaging in the direction of the arrows (C, D; E, F). As far as details are concerned, the roller sections of the bottom rollers 12 to 15; 16 to 19 and the clutches 43 as well as the actuating mechanism for the coupling rails 50, 51 may be constructed, for example, corresponding to the arrangement of German Patent Application P 38 44 072.5, corresponding to U.S. patent application Ser. No. 07/455,187, filed Dec. 22, 1989, now U.S. Pat. No. 4,991,263, issued Feb. 12, 1991, which is no prior publication.

The two drafting units 3, 4 are supplemented by a bottom roller 20 which is constructed as a drivable bottom cylinder which extends through in the longitudinal direction of the machine. Top rollers 21 to 30 are assigned to the bottom rollers 12 to 20, are constructed as so-called pressure roller pairs and are held in a loading arm 31 by means of loading devices. The loading arm 31 is pivotally disposed on the cross-piece 8 by means of a bent projection 35. The loading arm 31 is manufactured as a bent sheet metal profile which has two longitudinal supports 32, 33 and two transverse supports 34, 36.

The transverse support 36 of the loading arm 31 situated in the area of the transverse support 9 of the supporting element 5 is provided with a recess 37, into the area of which a locking lever 38 projects which is equipped with an actuating button 40 at its extreme end. The locking lever 38 is pivotally arranged on the transverse support 9 of the supporting element 5. In the locking position, it reaches, by means of a recess around a transverse rod 39 provided with lateral centerings which is fastened to the loading arm 31.

As shown in FIGS. 1 and 2, the air nozzles 61, 62; 64, 65 are situated in the area of the transverse support 36 of the loading arm 31. The air nozzles 61, 62; 64, 65 are fastened by means of holders 60, 63 to the transverse support 9 of the supporting element 5 so that they are part of the structural component which is supported by the supporting element 5. The supporting element 5 is fastened to roller stands 10, 11 in which the drive shafts 46 to 49 are disposed.

Figure 3:
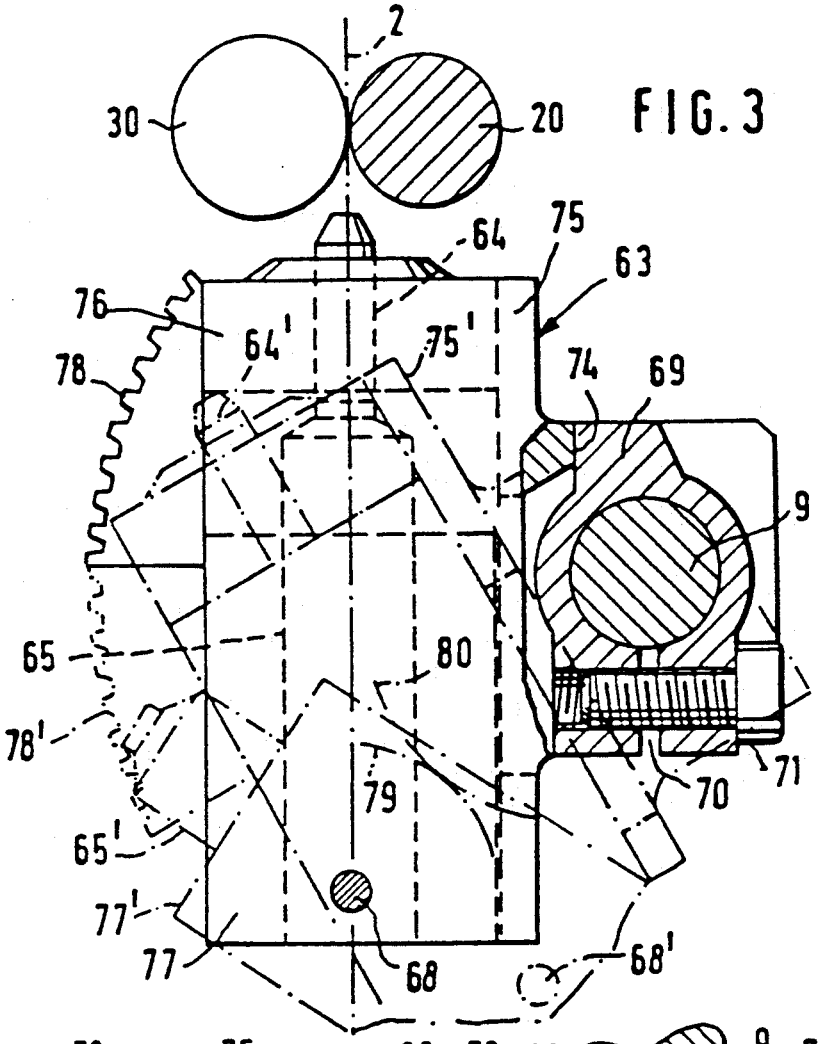
FIG. 3 is an enlarged detail of the embodiment according to FIG. 1 in the area of a holding device of air nozzles.
Figure 4:
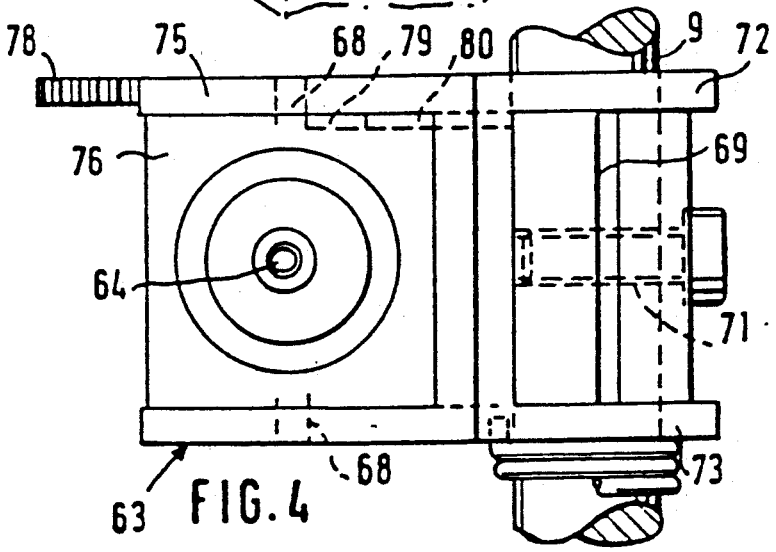
FIG. 4 is a view of the detail of FIG. 3 viewed in the direction of the air nozzles.

The holders 60, 63 for the air nozzles 61, 62; 64, 65 have an identical construction so that it suffices to explain only the construction of the holder 63 by means of FIGS. 3 and 4.

The holder 63 has a U-shaped basic body 75 which, by means of two tabs 72, 73 projecting away from it, is pivotally disposed on the rod serving as the transverse support 9 of the supporting element 5. Between the two tabs 72, 73, a stop element 69 is arranged which is provided with a longitudinal slot 70 in the area of which a locking screw 71 is disposed. The stop element 69 can therefore be adjusted in the desired position and can be clamped fast on the transverse support 9. The stop element 69 forms a stop face 74 for a counterface of the holder 63.

The basic body 75 accommodates a cuboid holding element 76 between its two legs in the area facing the pair of delivery rollers 20, 30, this holding element 76 being fixedly connected with the holder 63. This holding element 76 carries the air nozzle 64 which is first in the travelling direction of the yarn. At a distance from it, another essentially cuboid holding element 77 is arranged at the holder 63 between the legs of the U-shaped basic body 75 and accommodates the second air nozzle 65. This holding element 77 can be swivelled around pins 68 in the holder 63 which form a swivelling axis extending in parallel to the transverse support 9.

A toothed wheel segment 80, which is coaxial with respect to the transverse support 9, is mounted at the stop element 69 and is only outlined in FIG. 3. This non-rotatably arranged toothed wheel segment 80 penetrates the holder 63 in a recess. Another toothed wheel segment 79, which is mounted at the holding element 77 and which extends concentrically with respect to the swivel axis formed by the pin 68, mates with toothed wheel segment 80.

In FIG. 3, the holder 63 is shown by solid lines in the operating position in which the first air nozzle 64 is directed to the clamping gap of the pair of delivery rollers 20, 30. The holder 63, together with the air nozzles 64, 65, can be swivelled around the transverse support 9, into the servicing position shown by a dash-dotted line in FIG. 3. This swivelling takes place, for example, by means of an actuating element of a servicing carriage which is not shown and can be moved along the spinning machine and which, by means of a toothed wheel, engages in a tooth segment 78 which is mounted at one of the legs of the U-shaped basic body 75 of the holder 63. By the swivelling of the holder 63 into the servicing position, the air nozzle 64 is swivelled along into the servicing position 64'. The inlet opening to the air nozzle 64' is then easily accessible for a servicing operation. As a result of the forced guiding generated by the two toothed wheel segments 79, 80 in connection with the swivel shaft formed by the pin 68, the air nozzle 65 is swivelled into the servicing position 65' into which, in comparison to the servicing position 64' of the air nozzle 64, it was swivelled away at a larger angle. For example, the air nozzle 64 swivels by an angle of approximately 30° into the servicing position 64', while the air nozzle 65 swivels by approximately 60° into its servicing position 65'. The inlet opening of the air nozzle 65, which is in its servicing position 65', will then also be easily accessible for a cleaning element or the like. When the holder 63 is swivelled back into the operating position, because of the restricted guidance, the air nozzle 65 is also swivelled back into its operating position. This swivelling-back can also be carried out by the servicing carriage. Advantageously, the operating position is secured by a spring element which is not shown, such as a torsion springs arranged between the holder 63 and the transverse support 9. However, it is also possible to secure the operating position by way of a corresponding locking element of the loading support 31 because a swivelling-away into the servicing position takes place only if the drafting units 3, 4 were opened up by the swivelling-away of the load support 31.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning machine arrangement for pneumatic false twist spinning including at least one spinning unit, each of said at least one spinning units comprising:

a drafting unit for drafting sliver, said drafting unit including a pair of delivery rollers at its downstream end, a first air nozzle disposed downstream of the delivery rollers, a movable air nozzle holder for holding the first air nozzle, a second air nozzle disposed downstream of the first air nozzle, and a restricted guidance system for controlling adjusting movement of the first and second air nozzles between an operating spinning position with the first and second air nozzles axially aligned with one another and a servicing position with the first and second air nozzles out of axial alignment with one another, said restricted guidance system including a transmission device for transmitting movement of said first nozzle to the second nozzle while continuously maintaining a predetermined ratio of movement of the first and second nozzles with the second nozzle moving a greater distance than the first nozzle for all adjusted positions of the first and second nozzles.

2. A spinning machine arrangement according to claim 1, wherein the nozzle holder is a common nozzle holder for both air nozzles, wherein the two air nozzles are supportably held in the common nozzle holder, said common nozzle holder being movable about a first swivel shaft, wherein the first nozzle is held in the common nozzle holder for movement therewith, and wherein the second air nozzles is movable about a second swivel shaft which is carried by the common nozzle holder.

3. A spinning machine arrangement according to claim 2, wherein the transmission device includes a transmission mechanism which moves the second air nozzle about said second swivel shaft in response to movement of the common nozzle holder and first air nozzle about the first swivel shaft.

4. A spinning machine arrangement according to claim 3, wherein said transmission mechanism includes a first toothed wheel segment at the common nozzle holder which mates with a second toothed wheel segment at the second air nozzle.

5. A spinning machine arrangement according to claim 4, wherein said first and second swivel shafts are parallel to one another.

6. A spinning machine arrangement according to claim 5, further comprising a spring for biasing the common nozzle holder towards a spinning operating position in which the common nozzle holder rests against a step.

7. A spinning machine arrangement according to claim 5, wherein said common nozzle holder includes an actuator abutment for abuttingly engaging an actuator of a servicing device, whereby the actuator can move the holder about said first swivel shaft.

8. A spinning machine arrangement according to claim 5, wherein the first and second swivel shafts are spaced from one another.

9. A spinning machine arrangement according to claim 4, further comprising a spring for biasing the common nozzle holder towards a spinning operating position in which the common nozzle holder rests against a stop.

10. A spinning machine arrangement according to claim 4, wherein said common nozzle holder includes an actuator abutment for abuttingly engaging an actuator of a servicing device, whereby the actuator can move the holder about said first swivel shaft.

11. A spinning machine arrangement according to claim 3, further comprising a spring for biasing the common nozzle holder towards a spinning operating position in which the common nozzle holder rests against a stop.

12. A spinning machine arrangement according to claim 3, wherein said common nozzle holder includes an actuator abutment for abuttingly engaging an actuator of a servicing device, whereby the actuator can move the holder about said first swivel shaft.

13. A spinning machine arrangement according to claim 3, wherein two adjacent drafting units respectively are combined to form a structural component which has a supporting element for the mounting of the structural component at a machine frame, the supporting element comprising common nozzle holders for the air nozzles of the two spinning points.

14. A spinning machine arrangement according to claim 2, further comprising a spring for biasing the nozzle holder towards a spinning operating position in which the nozzle holder rests against a stop.

15. A spinning machine arrangement according to claim 2, wherein said common nozzle holder includes an actuator abutment for abuttingly engaging an actuator of a servicing device, whereby the actuator can move the holder about said first swivel shaft.

16. A spinning machine arrangement according to claim 15, further comprising a spring for biasing the common nozzle holder towards a spinning operating position in which the common nozzle holder rests against a stop.

17. A spinning machine arrangement according to claim 2, wherein a plurality of said spinning units are provided, and wherein two adjacent drafting units respectively are combined to form a structural component which has a supporting element for the mounting of the structural component at a machine frame, the supporting element comprising common nozzle holders for the air nozzles of two spinning units.

18. A spinning machine arrangement according to claim 17, wherein the supporting element is constructed as a frame which has two supports extending in the passage direction of a fiber material to be drafted which accommodate bottom rollers constructed as roller sections, and two transverse supports of which one is used as the first swivel shaft for the common nozzle holders of the air nozzles and the other one is used as a holding rod for a loading arm accommodating top rollers.

19. A spinning machine arrangement according to claim 18, wherein a plurality of said spinning units are provided, and wherein the transverse support serving as the swivel shaft for the common nozzle holders of the air nozzles is used as the swivel shaft for a locking lever holding the loading arm in the operating position.

20. A spinning machine arrangement according to claim 1, wherein a plurality of said spinning units are provided.

* * * * *